US006733860B1

(12) United States Patent
Poulakis

(10) Patent No.: US 6,733,860 B1
(45) Date of Patent: May 11, 2004

(54) ADHESIVE CLOSING PART, METHOD FOR PRODUCING THE SAME DEVICE FOR IMPLEMENTING SAID METHOD

(75) Inventor: Konstantinos Poulakis, Hildrizhausen (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/700,910

(22) PCT Filed: May 22, 1998

(86) PCT No.: PCT/EP98/03046

§ 371 (c)(1),
(2), (4) Date: Feb. 13, 2001

(87) PCT Pub. No.: WO99/60879

PCT Pub. Date: Dec. 2, 1999

(51) Int. Cl.[7] ..... B32B 3/00
(52) U.S. Cl. ..... 428/100; 428/99; 428/119; 24/442; 24/451
(58) Field of Search ..... 428/99, 100, 119; 24/442, 451

(56) References Cited

U.S. PATENT DOCUMENTS 3,364,058 A * 1/1968 Seibel ..... 117/46
4,009,304 A * 2/1977 Dixon et al. ..... 427/322
5,882,728 A * 3/1999 Buschges et al.

FOREIGN PATENT DOCUMENTS

| | | |
|---|---|---|
| EP | 0 377 843 | 7/1990 |
| EP | 0 754 416 | 1/1997 |
| EP | 0 809 952 | 12/1997 |

* cited by examiner

*Primary Examiner*—Alexander S. Thomas
(74) *Attorney, Agent, or Firm*—Smith, Gambrell & Russell, LLP

(57) ABSTRACT

The invention relates to an adhesive closing part, especially for foaming upholstery parts of car seats during production of the latter, comprising adhesive elements (10) arranged on one side for connection to corresponding adhesive elements of another adhesive closing part by forming an adhesive closure and connecting elements on the other side of the adhesive closing part for producing a connection to the corresponding foam material. A reliable and high-strength connection to the foam material is achieved due to the fact that the connecting elements consist of an adhesive medium, especially a fluorine gas, applied at least on the other side of the adhesive closing part.

8 Claims, 1 Drawing Sheet

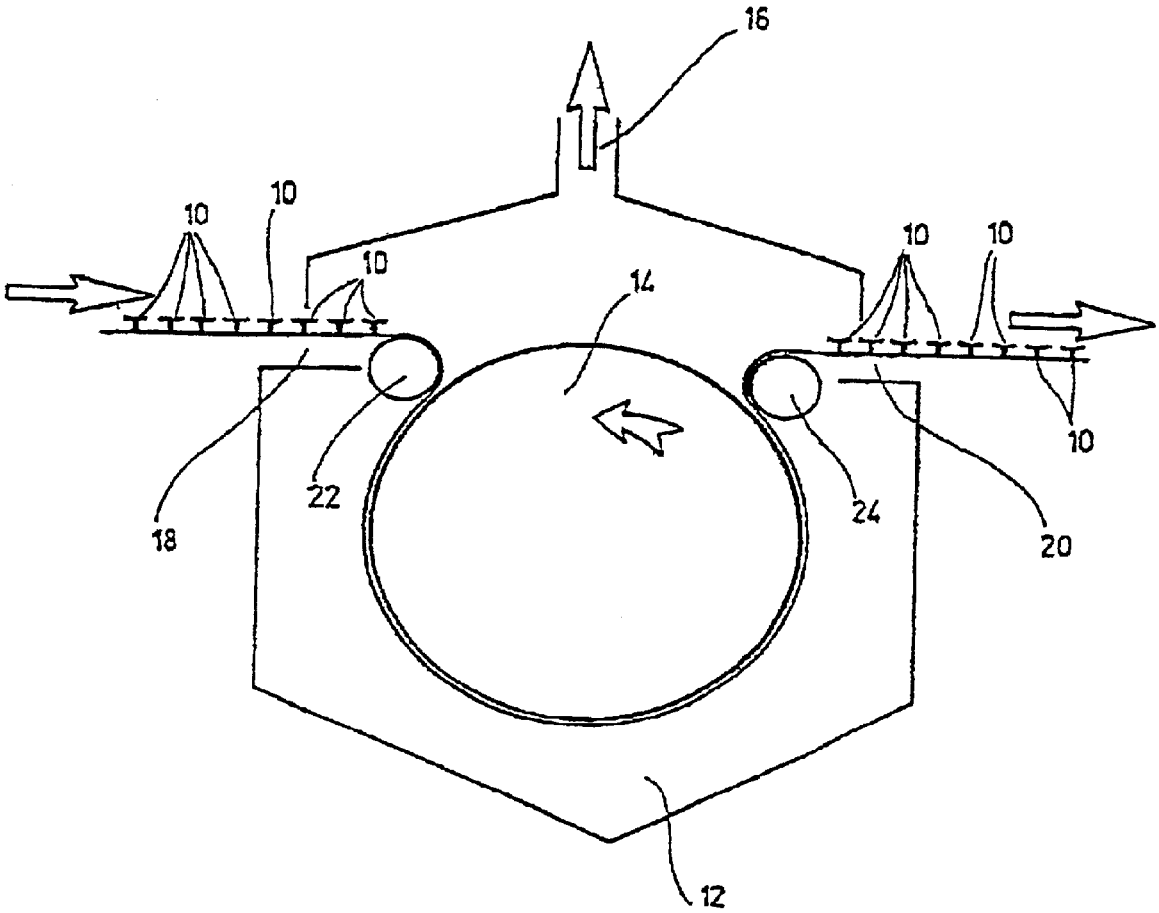
16
10
10
10
10
10
14
10
18
22
24
20
12

ADHESIVE CLOSING PART, METHOD FOR PRODUCING THE SAME DEVICE FOR IMPLEMENTING SAID METHOD

The invention involves a fastening part, especially for the foaming of cushion parts in the manufacture of vehicle seats, with adhesive elements on the one side to link with corresponding adhesive elements of another fastening part forming a fastening and with one connecting element in the nature of a fastening medium on the other side of the fastening part for the making of a connection with the respective foam material. The invention also involves a process for the manufacture of a fastening part to that effect as well as a device for the application of the process.

Fastening parts in a general form are known through EP 0 612 485, whereby the fastening part is laid in a foam form so that the bonding agent, in the form of loop elements on the backside of the adhesive closure part, comes into contact with the pertinent foam material, so as to produce a firm bond with it. The opposite front side of the adhesive closure part has adhesive elements in the form of bonding hooks, adhesives heads, mushroom-shaped bodies, or the like, which are protected from the penetration of foam material, for example, as described in the European document, in that they are surrounded, on their entire surface, by an uncrosslinked thermoplastic. If after the foaming process in the mold and the removal of the foamed part, the cover is removed, the adhesive elements are free and can later be joined with adhesive elements of another adhesive closure part, for example, in the form of a loop strip, with the formation of a common adhesive closure.

In this way, it is possible to affix, for example, upholstery covering materials on the foamed upholstery parts of a vehicle seat or an airplane seat or to join rotating components, for example, in the form of grinding wheels with tool rests, to traditional grinders and apparatuses. The aforementioned foam material can definitely be thinly liquid, as a function of the object to be formed, and have viscosities which are in the range of water or below. It has become evident that when using looping or noose-like material as a bonding agent or even when using a nappy cloth or the like, the nooses, which are, in fact, open, are not completely penetrated by the foam material, but rather form a kind of barrier for it, which inhibits the penetration of the foam material. In the subsequent hardening or baking process for the foam material, there are voids then—that is, gaslike hollow occlusions, which work against a firm bonding between the adhesive closure part and the foam material, at the transition sites between the looping material and the foam. As a result of such reduced strength of the bonding between the fastening parts and foam material in particular in continuous stress it comes to a loosening of the connection and the fastening part pulls apart from the foam material, which in all leads to the unusability of the entire component, for example in the shape of a vehicle seat or grinding wheel adapter.

A general fastening part is known through EP-A-0809 952, which is composed of a biologically degradable synthetic material. In the known solution, the individual adhesive elements are formed of neighboring facing double-hook elements each of which has a reinforcing rib on the side facing the band-like fastening part. On the other side of the fastening part as a connecting element, a medium is arranged in the form of a water-soluble resin-like material, which after penetration of water forms a kind of separate adhesive layer on the fastening material, without thereby putting into question the biodegradability of the entire fastening. The application of an independent adhesive layer as an adhesive medium on the side of the fastening part turned away from the adhesive elements is also the object of EP-A-0754 416. In this known solution, the adhesive application as an adhesive medium to that end occurs through a coating process. It has been shown, however, that independently of the selection of adhesive no good connection comes into being between the fastening part and the foam material and that in particular in the subsequent stressing of the foam material it comes to a pulling apart and hence to a loosening of the connection between the fastening part and the foam material.

Based on this state of the art, the invention has the function of further improving a fastening part so that a more secure and high-strength connection is achieved between the fastening part and the respective foam material that is used. Furthermore the invention has the function of making available a process for the manufacture of a fastening part to that end as well as a device for the application of this process. A task to this end is resolved by a fastening part with the features of claim 1, a process with the features of claim 3, and a device with the features of claim 5.

Because the adhesive medium is fluorine in accordance with the characterizing part of claim 1, it comes to a high-strength connection between the fastening part so treated and the respective foam material, which is detachable only with difficulty, so that the result is also a long-lasting secure connection between the fastening part and the later foam body. Through the adhesive medium that penetrates into the fastening part and is incorporated into this part, a surface-selective chemical reaction is produced on the fastening part that leads to good connection values with the foam material. In contrast to the known solutions, the adhesive medium is not applied separately to the fastening material as a kind of adhesive layer but is a laid-in component of the fastening.

For a specialist in the area of fastening and foaming technology, it is surprising that through the introduction of a gaseous adhesive medium on the fastening part he can achieve a better link with the foam material than by means of the known looped materials or through the usual adhesives that are expensive and hence cost-intensive in production and in which the loops, for example, spatially penetrate and push forward far into the foam material. Instead of a mechanical hooking of looped or noose-like material with the foam, an adhesion to the foam material is produced by means of the individually introduced adhesiveness medium during its production with heat and pressure, which leads to higher strength values with the desired bonding.

If fluorine is used as the gaseous adhesiveness medium to be introduced, preferably with adhesive closure parts made of polyolefin material, the hydrogen atoms fixed on the polyolefin surface are replaced by fluorine atoms. This substitution reaction takes place at room temperature. A starting or initial reaction is not required. The hydrocarbons, which are then partially fluorinated on the surface, behave completely different from the previous base material of the adhesive closure part. As a result of its high electronegativity, the fluorine atom tries to fill its outer electron shell. To this end, electrons are drawn away from adjacent carbon and hydrogen atoms. Therefore, one speaks of an induced polarity, which with the main base, constitutes the good adhesion with the foam material, preferably made of polyurethane foam.

An advantage of the fluorine treatment is a process-reliable adhesion with all polyolefins with an otherwise low surface tension, wherein there is a uniform penetration with the fluorine material, so that complicated configurations and surfaces, including back cuts, hollow spaces, interior surfaces, or the like, also obtain a fluorine treatment which favors adhesion. In order to attain as good as possible bonding values for the foam material, one has to take care that there is a sufficient number of polar fractions, wherein with polyolefin materials, polar fractions of 40 $mN/m^2$ and more are attained.

With the method in accordance with the invention for the production of a closure part with the previously designated features, the fluorine is applied in a nitrogen atmosphere, wherein the introduction of fluorine, continuously or discontinuously—with a moving or stationary adhesive closure part—can be effectively carried out. The storage of fluorine-nitrogen mixtures in high-pressure tanks has been the state of the art for many years and, as concerns the toxicology of such a gas mixture, it is similarly and safely regulated in safety data sheets and DIN standards, so that even with a large-scale use, there should be no worries about health risks.

With an apparatus in accordance with the invention for the carrying out of the previously described method, the adhesive closure parts to be treated are exposed to the fluorine-nitrogen gas atmosphere in a reduced pressure chamber. With the reduced pressure chamber, one can safely prevent the undesired emission of the fluorine-nitrogen gas mixture from the apparatus.

Such an apparatus can carry out a discontinuous method, in which the adhesive closure parts to be treated remain stationary in the apparatus for a prespecified time, or it can carry out a continuous method, in which an introduction and discharge of a continuous strip or a surface of an adhesive closure part takes place continuously.

In the following, the claimed invention is explained with the aid of the drawing in more detail. In a schematic representation, not drawn to scale, the FIGURE exhibits a longitudinal section through the apparatus with which it is possible to carry out the method of the invention to produce the claimed adhesive closure parts, in accordance with the invention.

The adhesive closure part, shown below, is used, in particular, for foamed upholstery parts of vehicle seats (not shown) during their production. The strip-like or sheet-like adhesive closure part has, on one side, adhesive elements 10 for bonding with corresponding adhesive elements of another adhesive closure part (not shown), with the formation of a common adhesive closure. The adhesive closure part shown in the FIGURE is produced by means of a common method, as shown for example by DE 196 46 318 A1. On the other side or on the underside of the adhesive closure part, a bonding agent is provided to produce a bonding with the pertinent foam material, for example, in the form of a polyurethane, which is introduced backwards into the adhesive closure part. The adhesive closure part itself is formed from a polyolefin-plastic material, wherein polyolefins are generally the all-embracing designation for polymers of the following general structure:

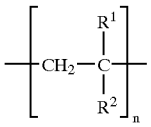

in which $R^1$ can mostly stand for hydrogen and $R^2$ for hydrogen, a straight-chain or branched, saturated, aliphatic or a cycloaliphatic group. Occasionally, polymers with aromatic groups, for example, the phenyl radical ($R^2C_6H_5$, see polystyrene) are also counted among the polyolefins. Products with $R^1$=H are also designated as poly(α-olefin)s; they can be considered vinyl polymers.

Polyolefins with great industrial importance in the field of adhesive closures are, for example, polyethylenes, polypropylenes, polybutenes, which are also occasionally, erroneously, called polybutylenes or polybutenes, as well as polyisobutenes and poly(4-methyl-1-pentene)s. Polymers of the higher α-olefins, for example, 1-polyhexene, 1-polyoctene, or 1-polyoctadecene, however, have had only very limited industrial application in this field up to now. Among the polyolefins are also copolymers of various olefins, for example, those of ethylene with propylene.

The adhesiveness medium is preferably fluorine and is introduced into the adhesive closure part via a subsequent fluorination. The aforementioned fluorine is used as $F_2$ and hence as gas, preferably in a nitrogen atmosphere.

Preferably, the introduction of the fluorine gas at 3% is undertaken, in accordance with the method of the invention, at room temperature and a reduced pressure of ca. 650 mbar. Such a method is continuously operated, which will be explained in more detail later. With a discontinuous introduction method, a temperature of 40° to 50° C. is preferably selected and the fluorine charge is increased to 10% in the nitrogen atmosphere.

BRIEF DESCRIPTION OF THE DRAWING

FIG. 1 is a cross-sectional view of an embodiment of the apparatus according to the present invention.

The apparatus according to the invention, as it is represented in the drawing, has a reduced pressure chamber 12, in which the adhesive closure parts are exposed to a fluorine-nitrogen gas atmosphere ($F_2/N_2$). Within the reduced pressure chamber 12, a guide roller 14 can pivot with the rotating direction in accordance with the represented part. On the upper side, the reduced pressure chamber 12 closes off in a connecting site 16, to which the discharge pump (vacuum pump), which is not depicted in more detail, is connected. Via such a connecting site 16, it is possible to adjust the desired reduced pressure, for example 650 mbar, within the reduced pressure chamber 12. Furthermore, room temperature should prevail in the reduced pressure chamber 12. Moreover, the reduced pressure chamber 12 has an entry 18 and an exit 20 for the untreated and for the adhesive closure part treated with fluorine.

In the transporting direction of the adhesive closure part 10, which is indicated with arrows, a first deflection roller 22 is located right behind the entry 18 and a second deflection roller 24, right before the exit 20. Such two deflection rollers 22,24 permit a direction deflection of the adhesive closure part in such a way that the individual adhesive elements 10 can mesh with recesses, which are not depicted in more detail, on the surface of the guide roller 14, so as to be able to at least partially withdraw, in such a way, from the fluorine-nitrogen atmosphere. Such introduction of the fluorine gas into the adhesive closure part therefore takes place predominantly along its back side, which is noose-free and which is to later produce the bonding with the foam material of the part to be foamed. The entry 18 and the exit 20 are located at a uniform level, moving in a horizontal direction. The material transport speed for the strip-like adhesive closure part is preferably 20 m/min and for such continuous method operation, 3% fluorine ($F_2$) is dissolved in the nitrogen atmosphere. For a discontinuous operation, for which the guide roller 14 is stopped, the temperature in the interior of the reduced pressure chamber 12 is preferably increased to 40° to 50° C., and the gaseous fluorine charge is increased to 10%. As a result of the adjusted reduced pressure in the reduced pressure chamber 12, the fluorine-nitrogen gas mixture cannot exit.

Insofar as it is provided for the entire adhesive closure part to be furnished with fluorine, this plays no part while foaming, in particular, so long as the adhesive elements 10 are covered, in the form, for instance, of a separable film or the like. In such a case, the application of foam to the adhesive elements 10 is effectively avoided by the covering and bonding with the foamed material takes place only across the rear side of the respective closure part treated in this way.

What is claimed is:

1. Process for manufacturing a fastening part for a foam material having adhesive elements on one side of the fastening part to connect with corresponding adhesive elements of another fastening part, and a connecting element in the nature of an adhesive medium on the other side of the fastening part to produce a connection with the foam material, wherein the adhesive medium is a laid-in component of the fastening part and consists of fluorine, said process comprising the following step:

applying a fluorine gas in a nitrogen atmosphere;

wherein the applying step is a continuous operation with 3 percent fluorine at room temperature and at a reduced pressure.

2. Process in accordance with claim 1, wherein the reduced pressure is 650 mbar.

3. Process for manufacturing a polyolefin fastening part for a foam material having adhesive elements on one side of the fastening part to connect with corresponding adhesive elements of another fastening part, and a connecting element in the nature of an adhesive medium on the other side of the fastening part to produce a connection with the foam material, wherein the adhesive medium is a laid-in component of the fastening part and consists of fluorine, said process comprising the following step:

applying a fluorine gas in a nitrogen atmosphere;

wherein the applying step is a continuous operation with 3 percent fluorine at room temperature and at a reduced pressure.

4. Process in accordance with claim 3, wherein the reduced pressure is 650 mbar.

5. Process for manufacturing a fastening part for a foam material having adhesive elements on one side of the fastening part to connect with corresponding adhesive elements of another fastening part, and a connecting element in the nature of an adhesive medium on the other side of the fastening part to produce a connection with the foam material, wherein the adhesive medium is a laid-in component of the fastening part and consists of fluorine, said process comprising the following step:

applying a fluorine gas in a nitrogen atmosphere;

wherein the applying step is a discontinuous operation with 10 percent fluorine at 40 to 50° C. and at a reduced pressure.

6. Process in accordance with claim 5, wherein the reduced pressure is 650 mbar.

7. Process for manufacturing a polyolefin fastening part for a foam material having adhesive elements on one side of the fastening part to connect with corresponding adhesive elements of another fastening part, and a connecting element in the nature of an adhesive medium on the other side of the fastening part to produce a connection with the foam material, wherein the adhesive medium is a laid-in component of the fastening part and consists of fluorine, said process comprising the following step:

applying a fluorine gas in a nitrogen atmosphere;

wherein the applying step is a discontinuous operation with 10 percent fluorine at 40 to 50° C. and at a reduced pressure.

8. Process in accordance with claim 7, wherein the reduced pressure is 650 mbar.

* * * * *